US005664729A

United States Patent [19]

Ladewig

[11] Patent Number: 5,664,729

[45] Date of Patent: Sep. 9, 1997

[54] MOLDED PLASTIC MAILBOX

[75] Inventor: Christopher G. Ladewig, Littleton, N.C.

[73] Assignee: Flambeau Products Corp., Middlefield, Ohio

[21] Appl. No.: 695,944

[22] Filed: Aug. 12, 1996

[51] Int. Cl.[6] ..... B65D 91/00

[52] U.S. Cl. ..... 232/39; D99/29

[58] Field of Search ..... 232/17, 39; 248/146; D99/29, 32

[56] References Cited

U.S. PATENT DOCUMENTS

| | | | |
|---|---|---|---|
| D. 253,435 | 11/1979 | Hale | D99/32 X |
| D. 335,380 | 5/1993 | Breen | D99/29 |
| D. 337,416 | 7/1993 | Kobilarcik et al. | D99/29 |
| 4,588,123 | 5/1986 | Plew | 232/39 |
| 5,307,598 | 5/1994 | West | 232/39 X |
| 5,400,959 | 3/1995 | Cone | 232/39 |
| 5,465,902 | 11/1995 | Hanson | 232/39 X |

*Primary Examiner*—Kenneth J. Dorner
*Assistant Examiner*—Jerry Redman

[57] ABSTRACT

A molded plastic mailbox is comprised of a series of component parts which are snap fitted and screwed together, including a hollow, vertical post with a first, upper end designed to be maintained above ground level and a second, lower end which is designed to support the post and mailbox below ground level. The upper end of the post includes a lug, which supports and receives a molded plastic platform upon which a molded plastic mailbox cover and doors are mounted. An optional newspaper chute may be attached to the lower side of the platform.

9 Claims, 8 Drawing Sheets

FIG.10
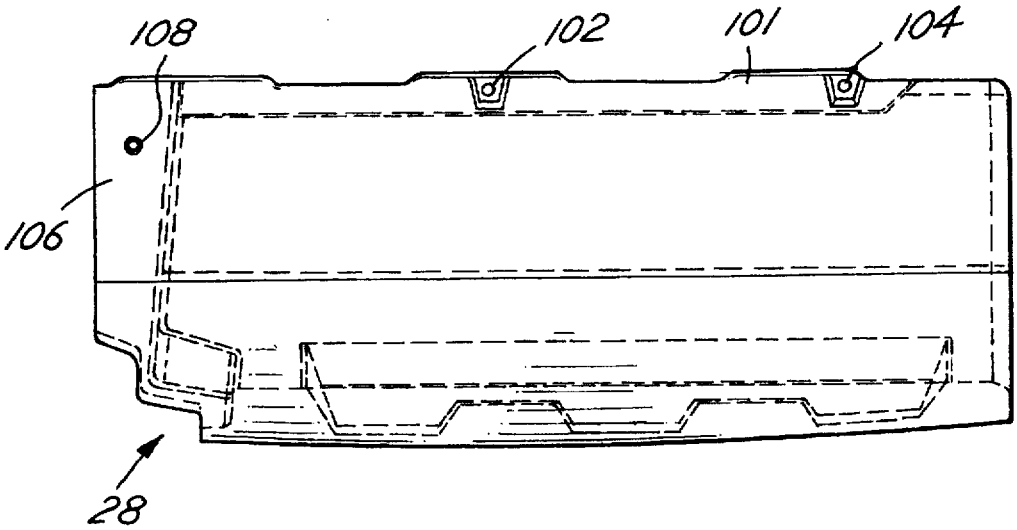
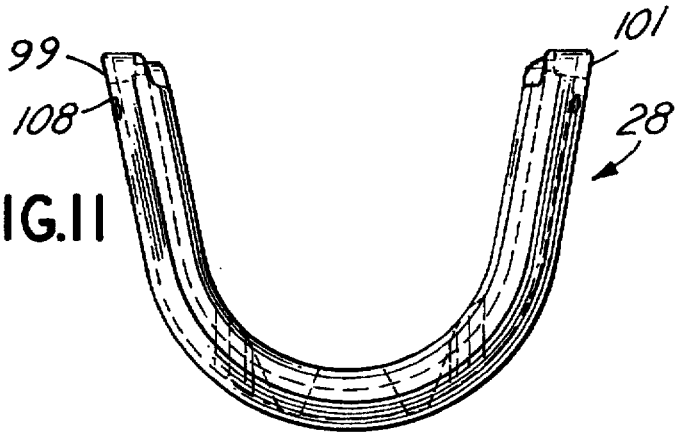
FIG.11
FIG.12
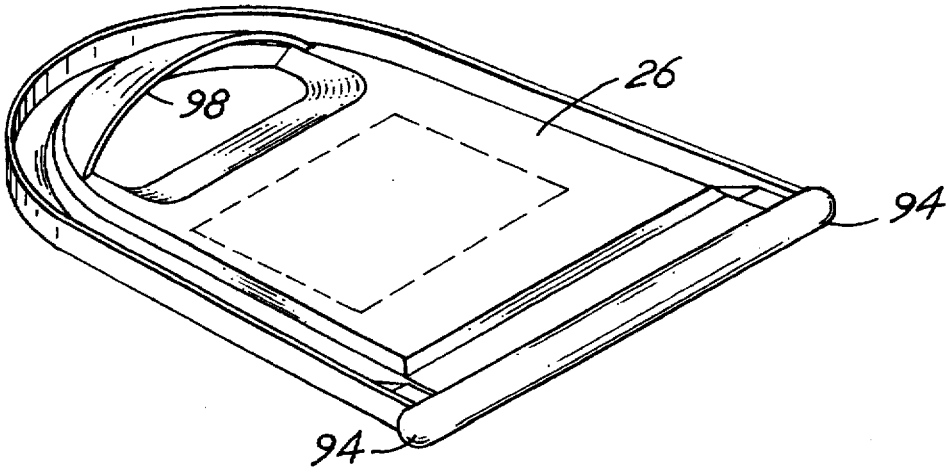

MOLDED PLASTIC MAILBOX

BACKGROUND OF THE INVENTION

This invention relates to a molded plastic mailbox, and, more particularly, to a plastic mailbox which includes a post for support of a mailbox, and wherein the component parts of the mailbox comprise an assembly of premolded plastic components manufactured by blow molding or roto-molding techniques.

Various constructions have been proposed for mailboxes, especially rural mailboxes. By way of example, Hanson, in U.S. Pat. No. 5,465,902, entitled Multi-Functional Mailbox, discloses a mailbox construction with a newspaper housing supported beneath the mailbox. Barrett et al., in U.S. Pat. No. 5,022,618, disclose a mailbox support post which may be used in combination with a stake driven into the ground, such as a steel fence post stake. Kobilarcik et al., in U.S. Pat. No. 5,337,954, disclose a mailbox construction manufactured from molded plastic material, including a mounting platform, which is utilized in combination with the mailbox, the assembly being mounted on a post.

The aforesaid disclosures depict items which are useful and yet there has remained the need for the development of an improved molded plastic mailbox assembly, particularly one which can be molded using roto-molding or blow molding techniques. The present invention was devised in order to utilize such techniques in the manufacture of an improved mailbox construction.

SUMMARY OF THE INVENTION

Briefly, the present invention comprises a molded plastic mailbox which includes an assembly of premolded plastic components that may be easily assembled from a kit. The premolded plastic components are manufactured using blow molding or roto-molding techniques. The components, which are separately molded for assembly include a post which has a first or above ground section and a second integrally molded below ground support section. The below ground support section is designed to be separable from the upper section, and the post is molded as a hollow construction, so that, if the parts are separated, the upper part may be positioned over a preexisting support post mounted in the ground. In the event a preexisting support post is not available, however, the post, which is comprised of the integrally molded upper and lower sections, and more particularly the below ground, support section, may be buried in the earth for holding the mailbox in position. Circumferential ribs on the lower or below ground support section facilitate the mounting of the structure in earth or soil. An opening, with a closure attached thereto, is provided in the lower section so that the lower section of the post may be filled with material, such as sand or concrete, to further facilitate retention of the post in the ground.

A molded horizontal support platform is designed to coact with a lug at the upper end of the support post. The support platform is adapted to receive an open ended, mail cover, which fits into parallel slots defined in the support platform. The opposite open ends of the mail cover receive hinged doors, thereby defining a mailbox enclosure. An optional newspaper chute may be suspended from the underside of the platform and attached to the post so as to enhance the structural rigidity of the assembly and provide a receptacle for newspapers and the like.

Thus, it is an object of the invention to provide an improved plastic molded mailbox.

It is a further object of the invention to provide an improved molded plastic mailbox comprised of separately a molded post, a horizontal support platform and a mailbox cover, as well as at least one hinged door attached to the cover.

Yet a further object of the invention is to provide a molded plastic mailbox comprised of component parts, which may be blow molded or roto-molded, and wherein the parts may be easily fabricated from a kit to provide a fully assembled mailbox.

Yet another object of the invention is to provide a molded plastic mailbox having a hollow molded plastic support post, which may be separated into an upper part and a lower part, wherein the upper part is hollow and may be fitted over a preexisting support in the earth.

Yet another object of the invention is to provide a molded plastic mailbox having a lower section which is designed to be retained in the earth, and which further includes means for facilitating retention by the earth and support of the mailbox.

Yet another object of the invention is to provide a mailbox comprised of a series of component molded plastic parts, which may be easily snap fitted or held together by fasteners.

Another object of the invention is to provide the molded plastic mailbox which is comprised of a series of premolded parts which may be arranged or provided in a kit for field assembly.

These and other objects, advantages and features of the invention will be set forth in the detailed description which follows.

BRIEF DESCRIPTION OF THE DRAWING

In the detailed description which follows, reference will be made to the drawings comprised of the following figures:

FIG. 10 is a side elevation of the newspaper chute;

FIG. 11 is a front elevation of the newspaper chute; and

FIG. 12 is an isometric view of a door panel used in combination with the mailbox cover of the invention.

DESCRIPTION OF THE PREFERRED EMBODIMENT

Figure 1:
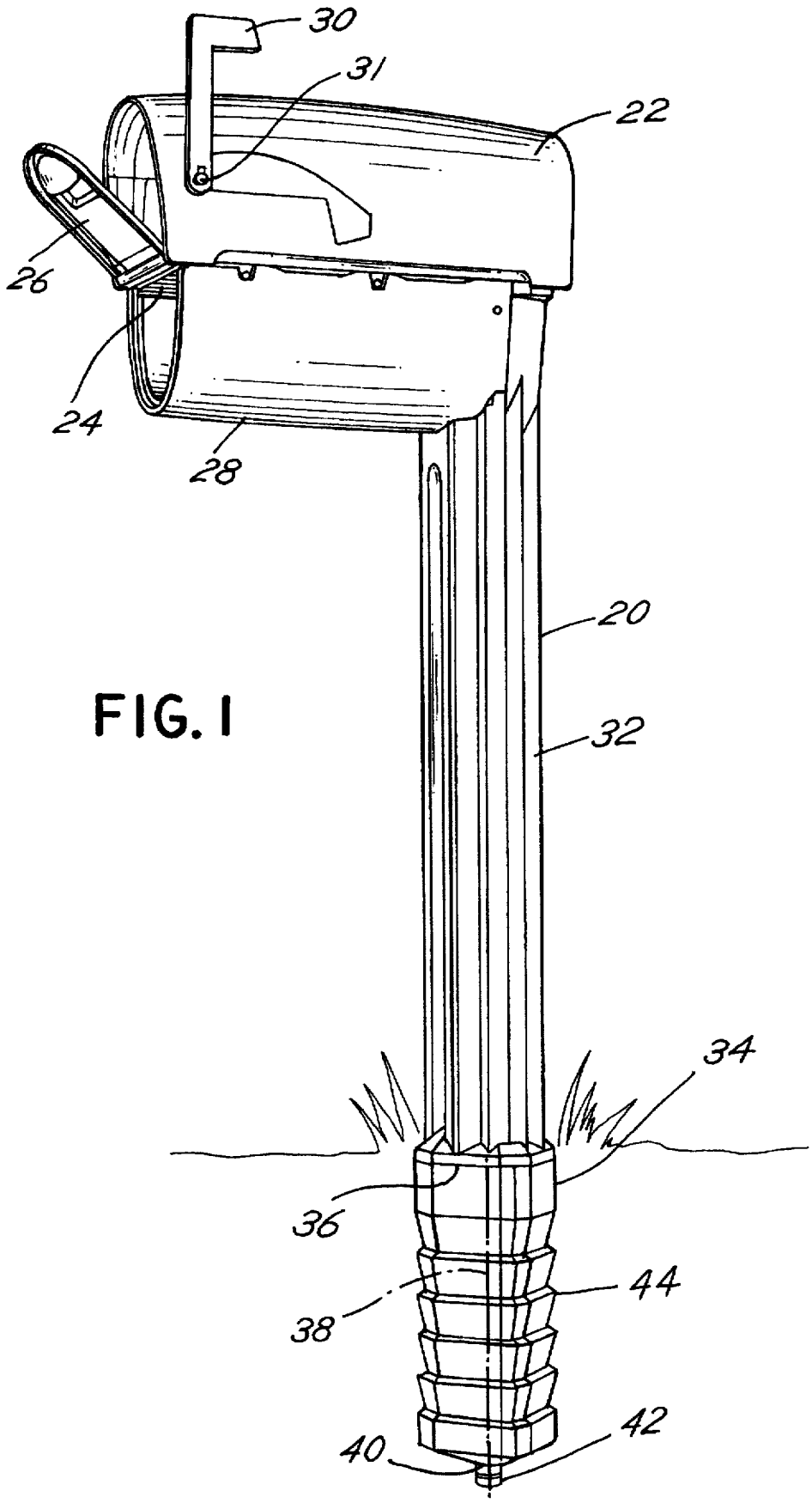
FIG. 1 is an isometric view of the assembled molded plastic mailbox, including a newspaper chute.
Figure 2:
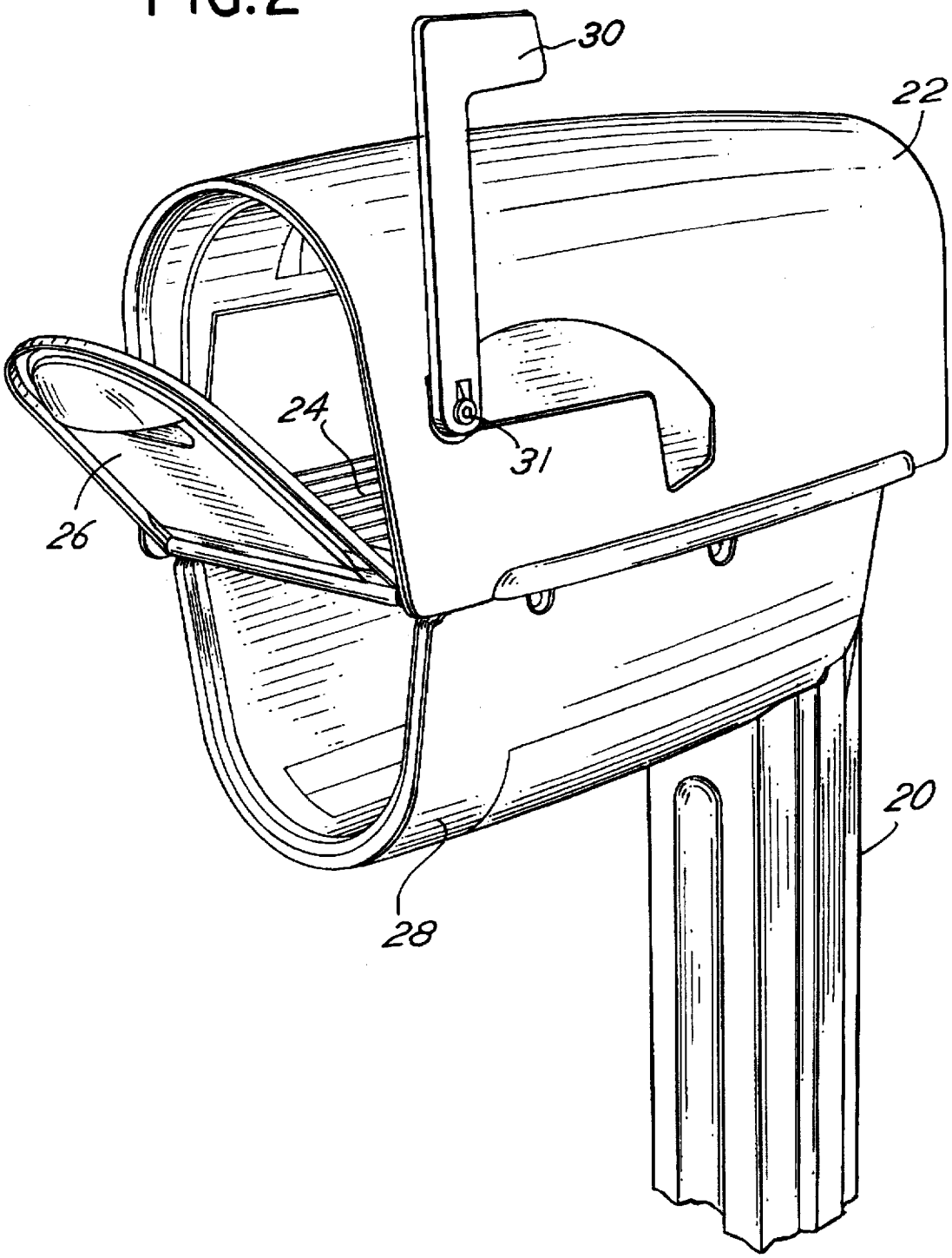
FIG. 2 is an enlarged isometric view of the mailbox hood and newspaper chute.

The molded plastic mailbox of the present invention is comprised of a series of separate molded elements that can be easily snap fitted or screwed together. Referring to FIG. 1, the assembled components are arranged to define an assembled molded plastic mailbox, which includes a vertical support post 20, a mailbox cover 22, a two-part support platform 24, a door 26 for the mailbox cover, and a newspaper chute 28. Additionally, as a separate component which is attached to the mailbox cover 22, a flag 30 is mounted pivotally about a pin 31.

The post 20 is molded as an integral, premolded component part by roto-molding or blow molding techniques. The post 20 includes an upper or first section 32 which is integrally joined to a below ground, lower or second section 34. The sections 32 and 34 are connected together along a separation line 36. Preferably, the post 20 is molded in a hollow configuration. The internal hollow structure, particularly of the first or upper section 32, is configured in cross section so that the hollow post 20 may optionally fit over a 4"×4" post (not shown) embedded in the ground. That is, the molded post 20 may be cut along the separation line 36 to remove the lower section 34. The upper section 32 may then be slid on or fitted over a post (not shown) already embedded in the ground and bolted thereto by fasteners which pass through the sides of upper section 32.

In the preferred embodiment, however, the post 20 remains with its two component parts 32 and 34 joined together. The lower or second section 34 likewise is hollow and the post defines a vertical axis 38. An opening 40 is provided at the bottom of the vertical axis 38 and a cap 42 is attached, for example, by threadable attachment over the opening 40. In this manner, the lower end of the post 20 may be filled with concrete, sand or the like in order to more firmly facilitate placement and retention in the ground. It will be noted that the separation line 36 is maintained roughly at ground level. It will be further noted that there are circumferential ribs or ridges in the lower section, such as ribs 44, which are vertically spaced one from the other to help maintain the post 20 rigidly or firmly in the earth.

Figure 3:
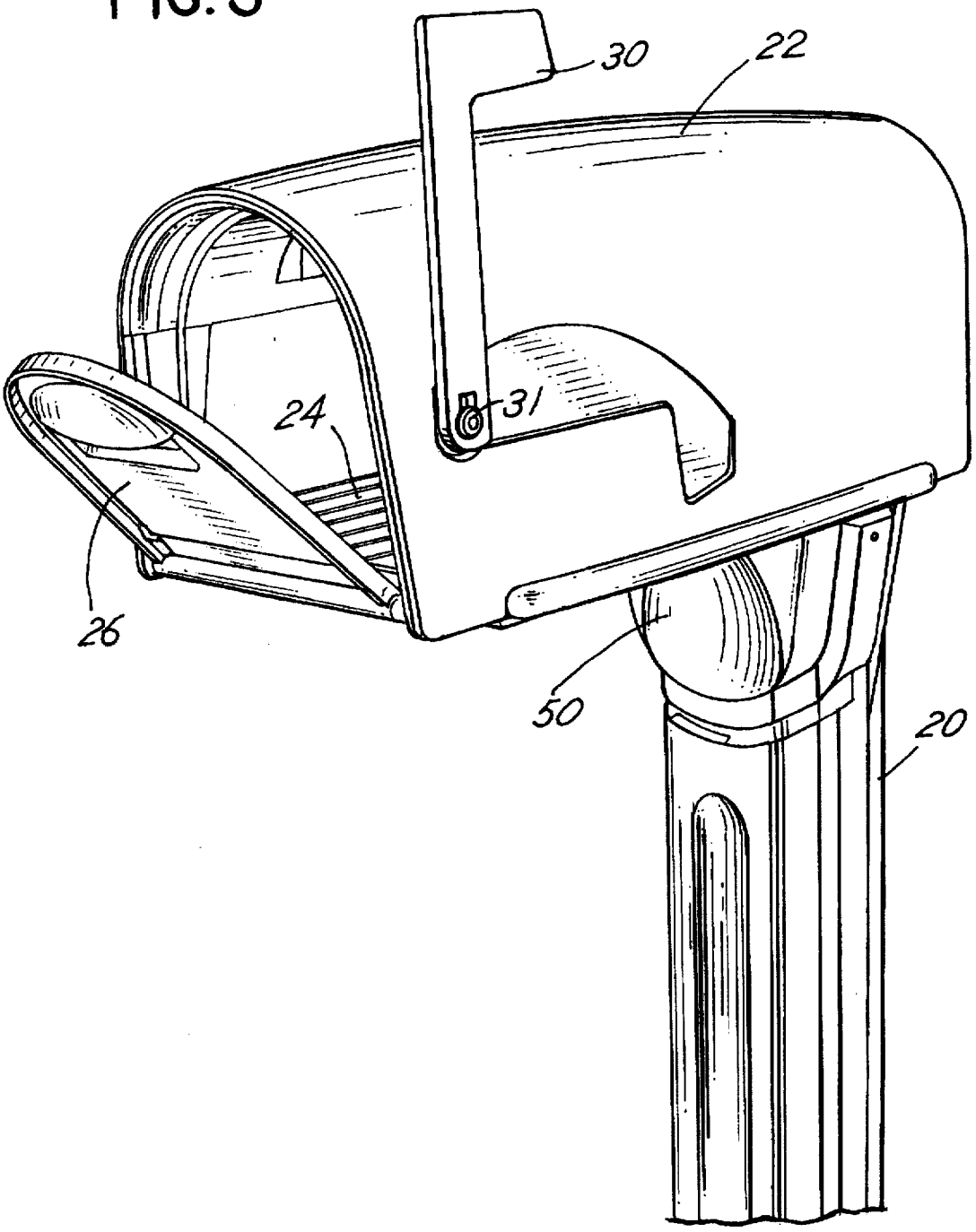
FIG. 3 is an enlarged isometric view of the mailbox hood.
Figure 4:
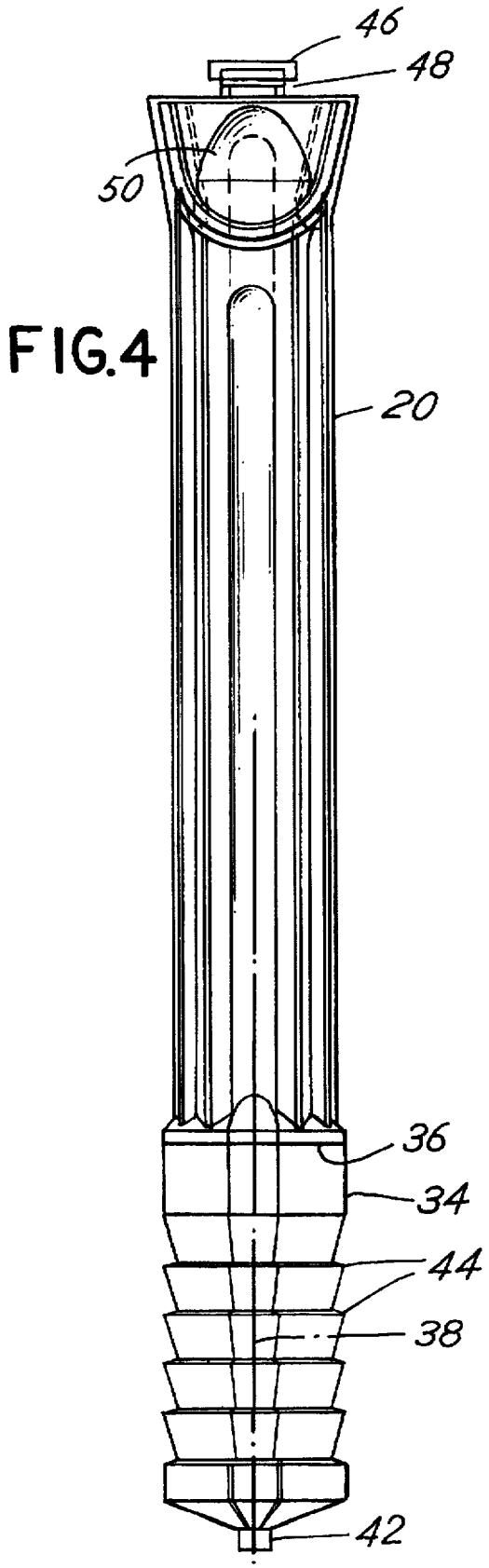
FIG. 4 is a front elevation of the molded support post for the mailbox.
Figure 5:
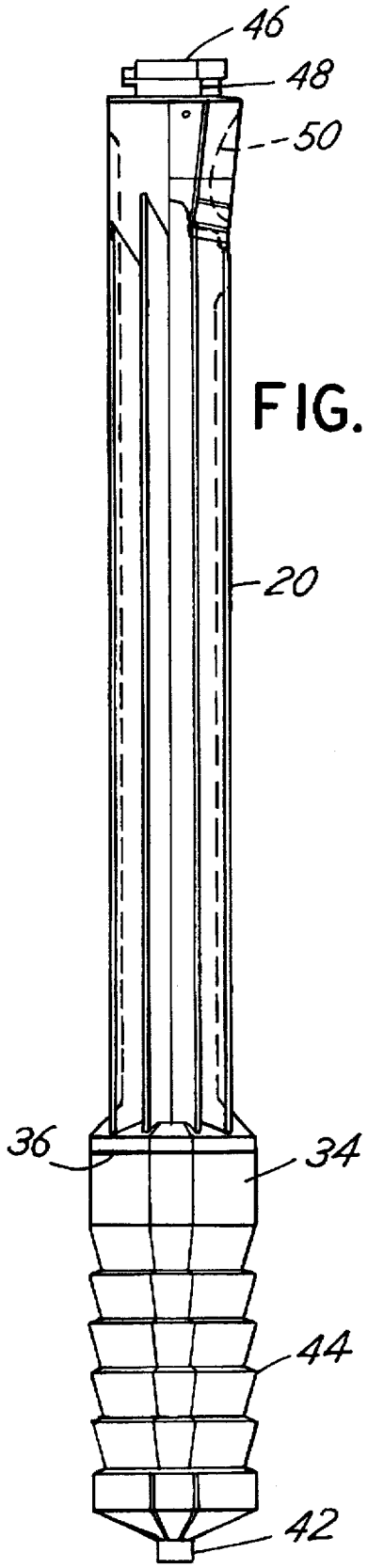
FIG. 5 is a side elevation of the post of FIG. 4.

The post 20 terminates at its top end with a formed lug 46. The lug 46 includes an undercut or recess 48 to facilitate cooperation with the platform 24 as described below. The post 20 also includes at its upper end a formed arcuate surface 50 in one side as depicted in FIG. 3, which is adapted to cooperate with the chute 28 again as described below.

Figure 6:
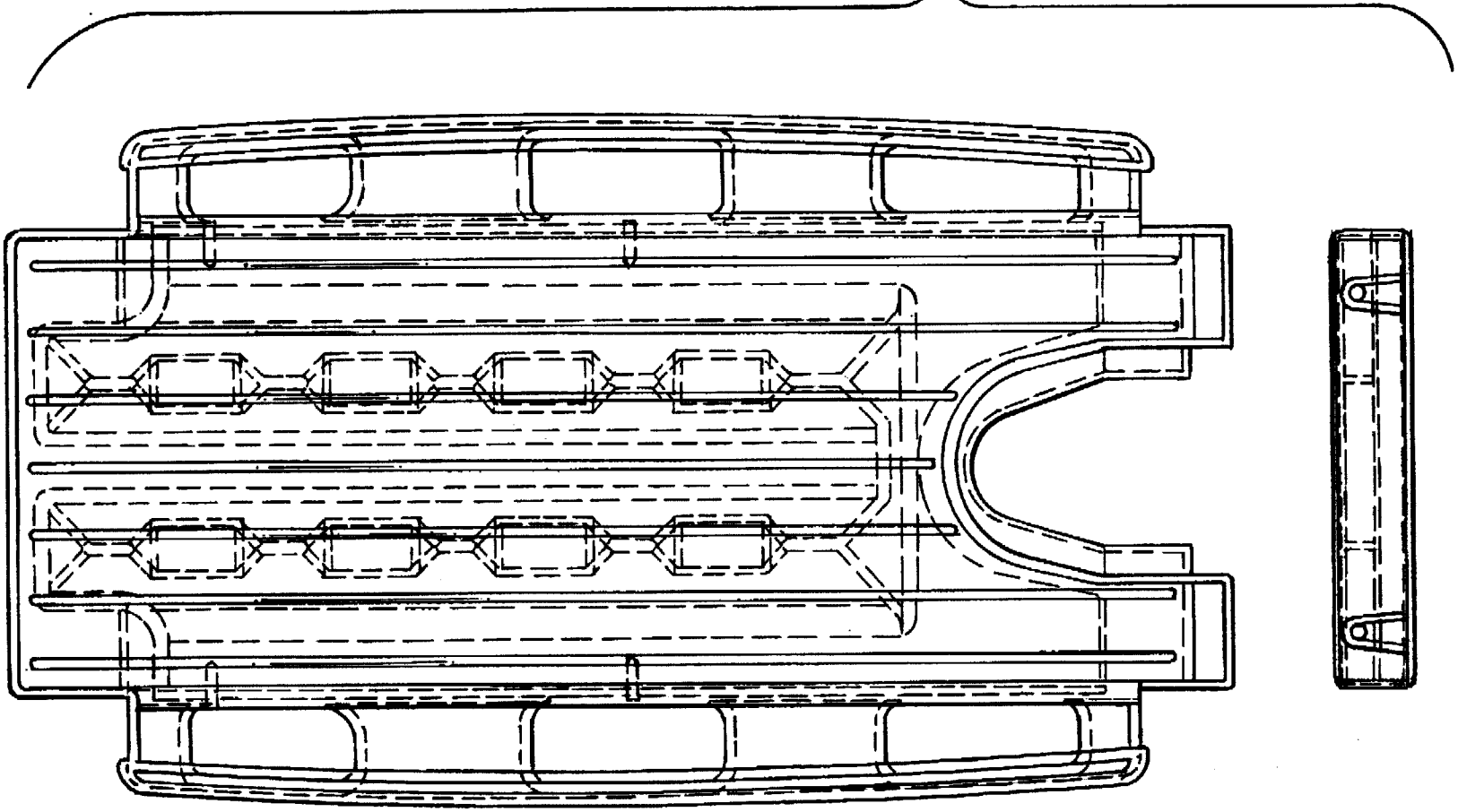
FIG. 6 is a top plan view of the platform components.
Figure 7:
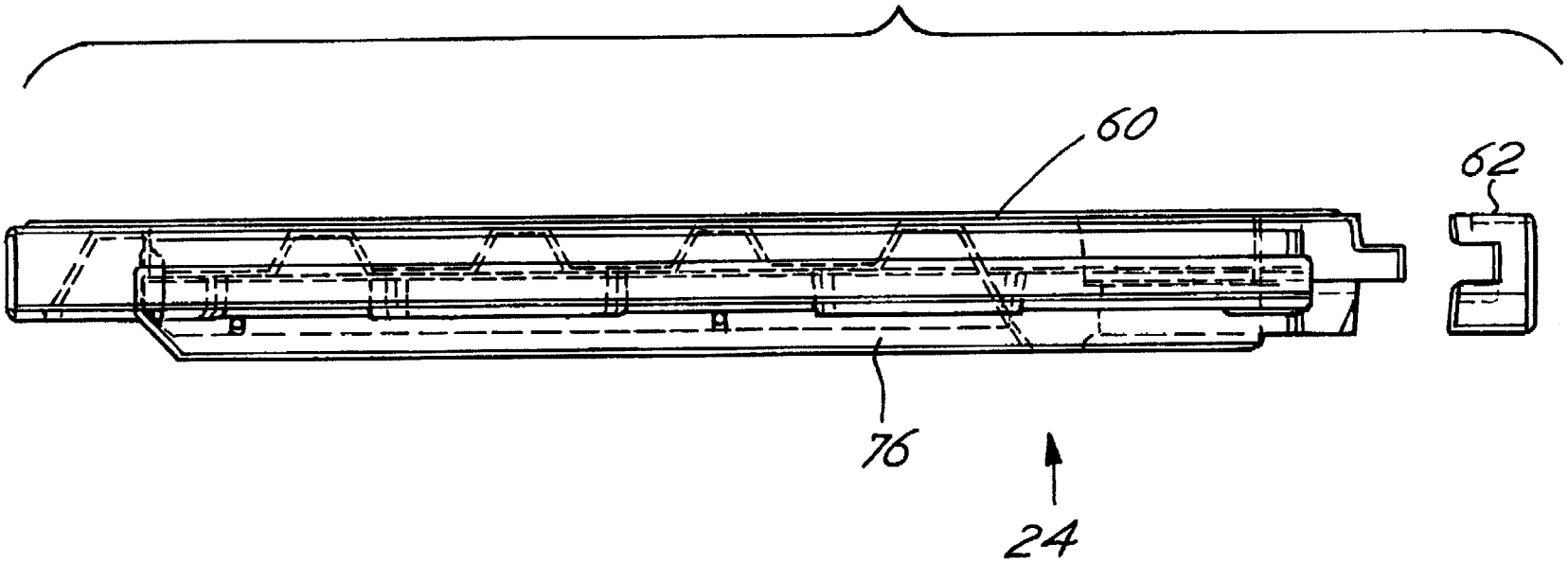
FIG. 7 is a side plan view or side elevation of the components of FIG. 6.

Referring next to FIGS. 6 and 7 there is depicted the component parts that form the platform 24. The platform 24 includes a main platform section 60 and an attachment or rear platform section 62. The platform 24 is generally planer and includes generally parallel longitudinal slots 64 and 66 on opposite sides of the platform 24 for cooperative receipt of the sides of the cover 22 as explained below. The platform 24 also includes a recessed opening or passage 68 with a flange 70 that cooperates or fits within the recess 48 of the lug 46 at the top of the post 20. The platform section or bracket 62 attaches to tabs 72 extending from the backside of the platform section 60 and may be screwed or threadably attached thereto to retain the platform 24 on the lug 46. Arranged along the lower edge of the platform 24 beneath the slots 64 and 66 are ribs such as rib 76 in FIG. 7 to which the newspaper chute is attached.

Figure 8:
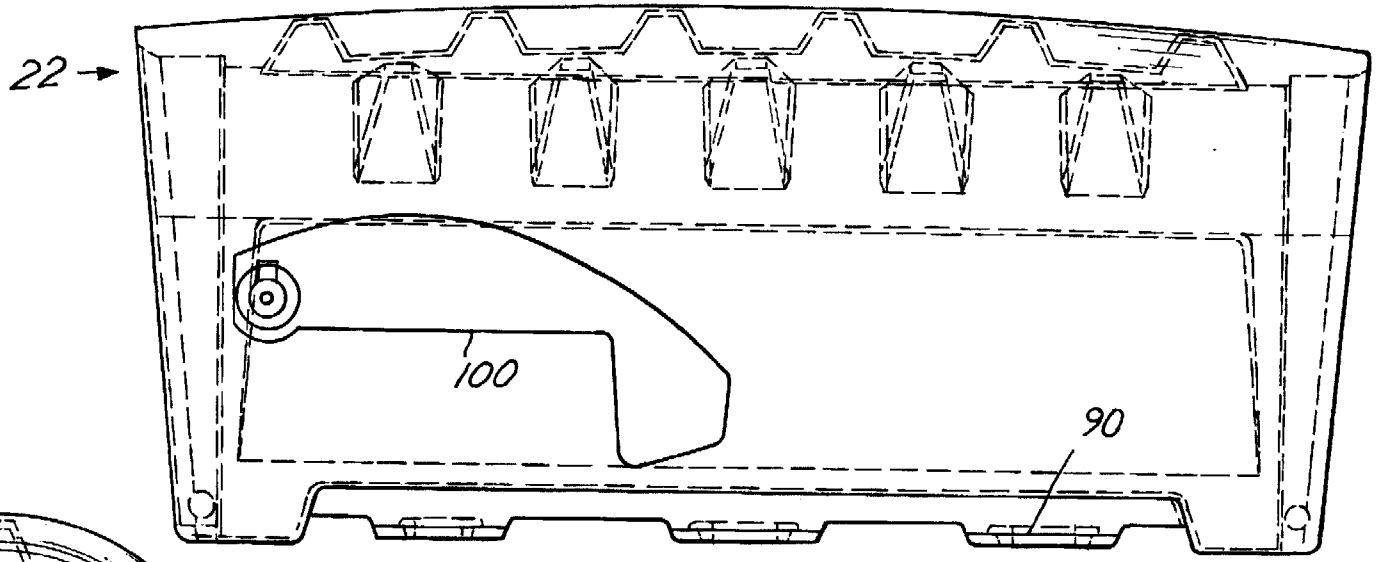
FIG. 8 is a side elevation of the cover or hood of the mailbox.
Figure 9:
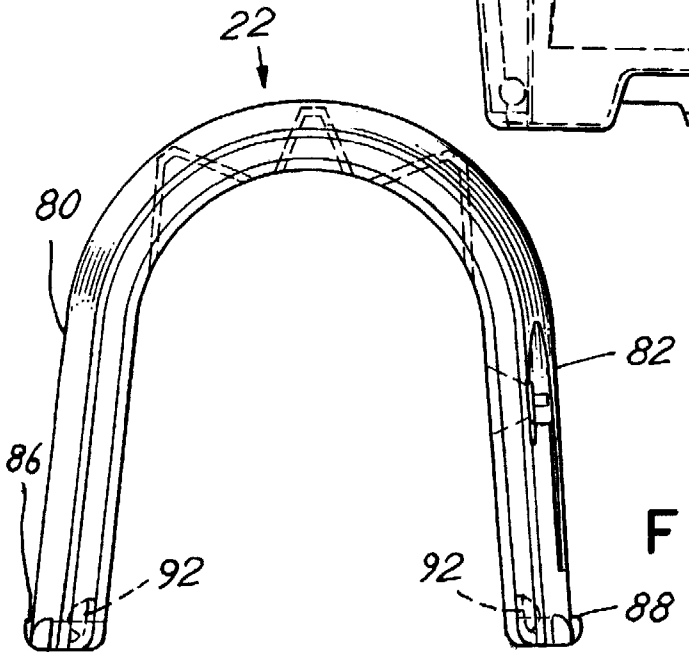
FIG. 9 is a front elevation of the hood of FIG. 8.

FIGS. 8 and 9 illustrate the construction of the mailbox cover or hood 22. The hood 22 has a pair of opposed, spaced sides 80 and 82 with lower, opposed, parallel edges 86 and 88 which include projecting ribs such as rib 90 which engage in appropriate detent slots defined in the channels such as large slot or channel 64 of the platform 24. In this manner, the cover 22 will be snap fitted into the platform 24. The opposite ends of the cover 22 are open. The opposite ends include opposed detent openings such as opening 92 which are adapted to receive hinge pins such as pins 94 molded in the door 26. These hinge pins 94 are depicted in FIG. 12 and they snap fit into the openings 92 in the sides of the cover 22 during the assembly process and define a pivot axis for the door 26. A door 26 is provided at each end of the cover 22 for access into each end. The door 26 is a molded plastic material and also includes an integrally molded, outside handle 98. The cover 22 further includes a molded stop 100 against which the flag 30 may rest when pivoted, as depicted, for example, in FIG. 8.

FIGS. 10 and 11 depict the molded plastic newspaper chute 28. The chute 28 has a generally, semi-cylindrical configuration and is open at both ends. The side edges 99 and 101 of the chute include openings, such as openings 102 and 104 through which fasteners may be attached to attach the chute 28 to the platform 24. Inside end or flange 106 of the chute 28, is configured so that it will be compatible with and appropriately engage the post 20, and more particularly, the curved, formed section 50 of the post 20. An opening 108 is defined in the flange 106 for receipt of a screw. Thus, opening 108 will receive a screw (not shown) to attach the newspaper chute 28 to the post 20.

As can be appreciated, the use of the chute 20 is optional. Additionally, there are other alternative constructions and configurations of the component parts of the molded plastic assembly comprising the mailbox. Thus, the invention is to be limited only by the following claims and their equivalents.

What is claimed is:

1. A molded plastic mailbox comprising, in combination, an assembly of premolded plastic components including:

a post having a first, above ground support section and a second, integrally molded, below ground support section, said post further having a vertical axis and including at the second, below ground support section, a series of at least partially circumferential ribs spaced vertically one above the other along the vertical axis of the post, said ribs comprising means for engaging and retaining the post in the ground, said post terminating with an attachment lug at a top thereof;

a molded horizontal support platform having a post attachment end, said post attachment end including means for attachment of the platform to the attachment lug for retaining the platform horizontally supported and extending outwardly from the vertical axis of the post, said platform further including spaced parallel slots on opposite sides of the platform for receipt of the sides of a molded cover;

said molded cover for mounting on the platform, said cover having a curved shroud with first and second parallel sides, an open outside end and an open inside end; and at least one hinged door attached to the cover shroud at least one of said open ends.

2. The mailbox of claim 1 further including a newspaper chute attached to the platform, said chute comprising an integrally molded, plastic, semi-cylindrical member having spaced, parallel edges, opposite open ends, and means for attaching the edges to the platform suspended below the platform with an open end of the cover and one open end of the chute aligned one above the other and the other open end chute portioned against the molded post to thereby enclose said open end.

3. The mailbox of claim 1 wherein the cover includes a pivotal flag attached on one side attached by a fastener, said cover including a rib integrally molded to support the flag in one position.

4. The mailbox of claim 1 wherein the cover includes, at the open ends thereof on an inside surface of opposite sides, opposed recesses, and said door includes projecting integrally molded hinge pins cooperative with respective recesses to pivotally hinge the door to the cover.

5. The mailbox of claim 1 wherein the cover includes an integrally molded handle on a front face and the cover includes molded projecting friction tabs for releasably holding the cover in a closed position.

6. The mailbox of claim 1 including a hinged door attached at each open end of the cover.

7. The mailbox of claim 1 wherein the molded post is hollow and further including an opening in the below ground section and a removable closure for said opening.

8. The mailbox of claim 7 wherein the opening is located on the vertical axis of the post at a lower end of the second ground support section.

9. The mailbox of claim 1 wherein the post is hollow and the second ground support section is separable from the first section, said first section defining a hollow passage for mounting on a vertical support post.

* * * * *